US006792728B2

(12) United States Patent
Toulemonde et al.

(10) Patent No.: US 6,792,728 B2
(45) Date of Patent: Sep. 21, 2004

(54) ELEMENTARY MODULE FOR PRODUCING A BREAKER STRIP FOR THERMAL BRIDGE BETWEEN A WALL AND A CONCRETE SLAB AND BUILDING STRUCTURE COMPRISING SAME

(75) Inventors: Charles Toulemonde, La Rochette (FR); Marion Escudero, Vulaines sur Seine (FR); Bernard Yrieix, La Grande Paroisse (FR)

(73) Assignee: Electricite de France - Service National, Paris (FR)

( * ) Notice: Subject to any disclaimer, the term of this patent is extended or adjusted under 35 U.S.C. 154(b) by 7 days.

(21) Appl. No.: 10/018,787

(22) PCT Filed: Apr. 13, 2001

(86) PCT No.: PCT/FR01/01164

§ 371 (c)(1),
(2), (4) Date: Dec. 21, 2001

(87) PCT Pub. No.: WO01/86082

PCT Pub. Date: Nov. 15, 2001

(65) Prior Publication Data

US 2003/0101669 A1 Jun. 5, 2003

(30) Foreign Application Priority Data

May 11, 2000 (FR) ..... 00 06022

(51) Int. Cl.[7] ..... E04B 1/00

(52) U.S. Cl. ..... 52/251; 52/309.7; 52/583.1; 52/236.9; 52/259

(58) Field of Search ..... 52/236.6, 236.7, 52/236.8, 236.9, 251–259, 309.7, 396.02, 396.04, 407.4, 585.1, 583.1

(56) References Cited

U.S. PATENT DOCUMENTS

| | | | | |
|---|---|---|---|---|
| 3,487,518 A | * | 1/1970 | Hopfeld | 29/897.35 |
| 4,059,935 A | * | 11/1977 | Faid | 52/396.02 |
| 4,740,404 A | * | 4/1988 | Otsugu et al. | 52/232 |
| 4,959,940 A | * | 10/1990 | Witschi | 52/583.1 |
| 5,195,293 A | * | 3/1993 | diGirolamo et al. | 52/745.13 |
| 5,325,647 A | * | 7/1994 | Forry et al. | 52/309.15 |
| 5,440,845 A | * | 8/1995 | Tadros et al. | 52/309.12 |
| 5,699,642 A | * | 12/1997 | McDevitt, Jr. | 52/719 |

FOREIGN PATENT DOCUMENTS

| | | | |
|---|---|---|---|
| DE | 3542467 | * | 6/1987 |
| DE | 19705698 | * | 8/1998 |
| EP | 119165 | * | 3/1984 |

* cited by examiner

*Primary Examiner*—Winnie Yip
(74) *Attorney, Agent, or Firm*—Sughrue Mion, PLLC

(57) ABSTRACT

An elementary module (21) having at least one beam, (11) made of a composite, and a longitudinal element, (22) made of an insulating material, right through which at least one channel (23) for housing the beam (11) passes. Also, a building structure provided with a thermal bridge break formed from such elementary modules (21).

23 Claims, 3 Drawing Sheets

ELEMENTARY MODULE FOR PRODUCING A BREAKER STRIP FOR THERMAL BRIDGE BETWEEN A WALL AND A CONCRETE SLAB AND BUILDING STRUCTURE COMPRISING SAME

BACKGROUND OF THE INVENTION.

The invention relates to buildings which include at least one thermal bridge break between a wall and an approximately horizontal concrete slab.

In general, a wall may separate a warm environment from a colder environment, for example the inside of a building from the outside.

In most cases, it is desired to provide insulation between these two environments, especially to limit the heat losses to the outside from a heated unit, to keep, on the other hand, the inside of a unit at a cool or moderate temperature when it is hot on the outside and/or to improve the thermal comfort of a construction intended for housing people.

A wall may also have the function of supporting approximately horizontal concrete slabs which are joined to it and which, for example, may form part of the construction of a floor. These slabs may rest on the ground. Very often they extend at a certain height above the ground, for example in the case of a lower storey. The joint between the wall and the slab is therefore intended to provide the slab with support on the wall side and to anchor it into the wall.

When this joint is provided by the concrete of the wall and/or the slab, and by the rebars contained in the concrete of the wall and/or the slab, a thermal bridge is created which helps to conduct heat between the end of the slab in contact with the wall and the wall itself. Such a joint forms a more marked thermal bridge when the faces of the wall on the slab side have been coated with an insulating material.

To limit heat exchange between the wall and the slab, it is known to provide thermal bridge breaks located at the junction between the wall and the slab by interposing a thickness of insulation between the inner face of the wall and the end of the slab. The mechanical joint between the slab and the wall is itself formed by means of a rebar which is run both into the concrete of the wall and into that of the slab and which passes through the thickness of insulation.

This rebar has a high thermal conductivity. Each reinforcement which constitutes it and which passes through the thickness of insulation from the slab and towards the wall, or vice versa, constitutes per se an elementary thermal bridge. The amount of rebars providing the mechanical joint can result in a not insignificant heat flux.

From a thermal standpoint, such an arrangement, although constituting an improvement over structures which were described above and which do not have any thermal bridge break device, is worthy of being further improved.

SUMMARY OF THE INVENTION

The object of the invention is therefore to increase the thermal performance of such a thermal bridge break, while maintaining the required mechanical properties of the joint between the wall and the slab, which slabs may in some cases extend approximately horizontally above a void.

For this purpose, the invention provides an elementary module intended to form a thermal bridge break between a wall and an approximately horizontal concrete slab, characterized in that it comprises:

- at least one beam made of a composite, intended to form a member for joining the slab to the wall and having a reduced ability to conduct heat; and

- a longitudinal element made of an insulating material, which is intended to be interposed between the slab and the wall and right through which at least one channel for housing the beam passes.

According to other features of this elementary module:

- the beam is made in the form of a section made of a polymer reinforced with a network of glass fibres and treated in order to be fireproof;
- one portion of the beam, located at one end of the beam and intended to be embedded in the slab, includes additional means for fastening to the slab;
- the additional fastening means comprise cramps;
- the additional fastening means comprise means for joining to a rebar in the slab;
- the section of the beam defines holes which extend along its length and are each intended to firmly house an iron bar forming a means of joining to the rebars of the slab;
- the beam is made in the form of a section;
- the beam includes a coating capable of withstanding hydrolysis;
- the coating is made of a resin;
- the beam is made of a high-performance concrete reinforced with polyethylene fibres;
- the beam has the overall shape of a section with a cross-section substantially in the form of a T;
- the cross-section of the beam has a bulge lying substantially at the free end of the base of the T; and
- the beam has a cross-section "in the form of a railway rail".

The subject of the invention is also a building structure comprising:

- at least one wall;
- at least one approximately horizontal concrete slab; and
- at least one thermal bridge break having a thickness of insulation interposed at the junction of the wall with the slab between a face of the wall and a corresponding end of the slab, characterized in that the thermal bridge break comprises a plurality of beams, distributed uniformly along the junction, each of the beams having, at a first end, a first portion rigidly secured to the wall, at a second end, a second portion embedded in the concrete of the slab and a third portion intermediate between the first portion and the second portion and passing through the thickness of insulation, the plurality of beams supporting the slab on the wall side and anchoring it into the wall.

According to further features of this building structure:

- the thermal bridge break is formed by a plurality of elementary modules as defined above, which are juxtaposed along the length of the junction between the wall and the slab;
- the base and the flanges of the T which substantially define the cross-section of the beam are oriented in approximately vertical and approximately horizontal directions, respectively;
- the base of the T which substantially defines the cross-section of the beam faces approximately upwards and the flanges of the T are below this base.

The beams allow the thermal performance of the thermal bridge break to be improved.

In the first place, the use of beams makes it possible to use materials, particularly composites, whose thermal conductivity is very much lower than that of iron.

In addition, the use of beams makes it possible to reduce the amount of material involved in the construction of the mechanical joint, and therefore the propagation of heat by and the degradation in thermal performance of the thermal bridge break.

Firstly, a beam has, for an equivalent amount of material, mechanical properties for joining and supporting the slab which are superior to those obtained with rebars.

Secondly, the beams are intended to be placed uniformly along the length of the junction, leaving an approximately constant space between each of them. The number of beams used per unit length of the junction is therefore well controlled.

Finally, the shape of the beams may be optimized so as to reduce their cross-section which also forms the heat flow area and which it is consequently desired to make as small as possible, while maintaining the required mechanical properties for providing the joint between the slab and the wall. By this means, the beams allow the thermal performance of the thermal bridge break to be further improved.

BRIEF DESCRIPTION OF THE DRAWINGS.

Other advantages, features and details of the invention will be apparent from the rest of the description which follows, with reference to the appended drawings, given by way of entirely non-limiting examples and in which.

DETAILED DESCRIPTION OF THE INVENTION.

Figure 1:
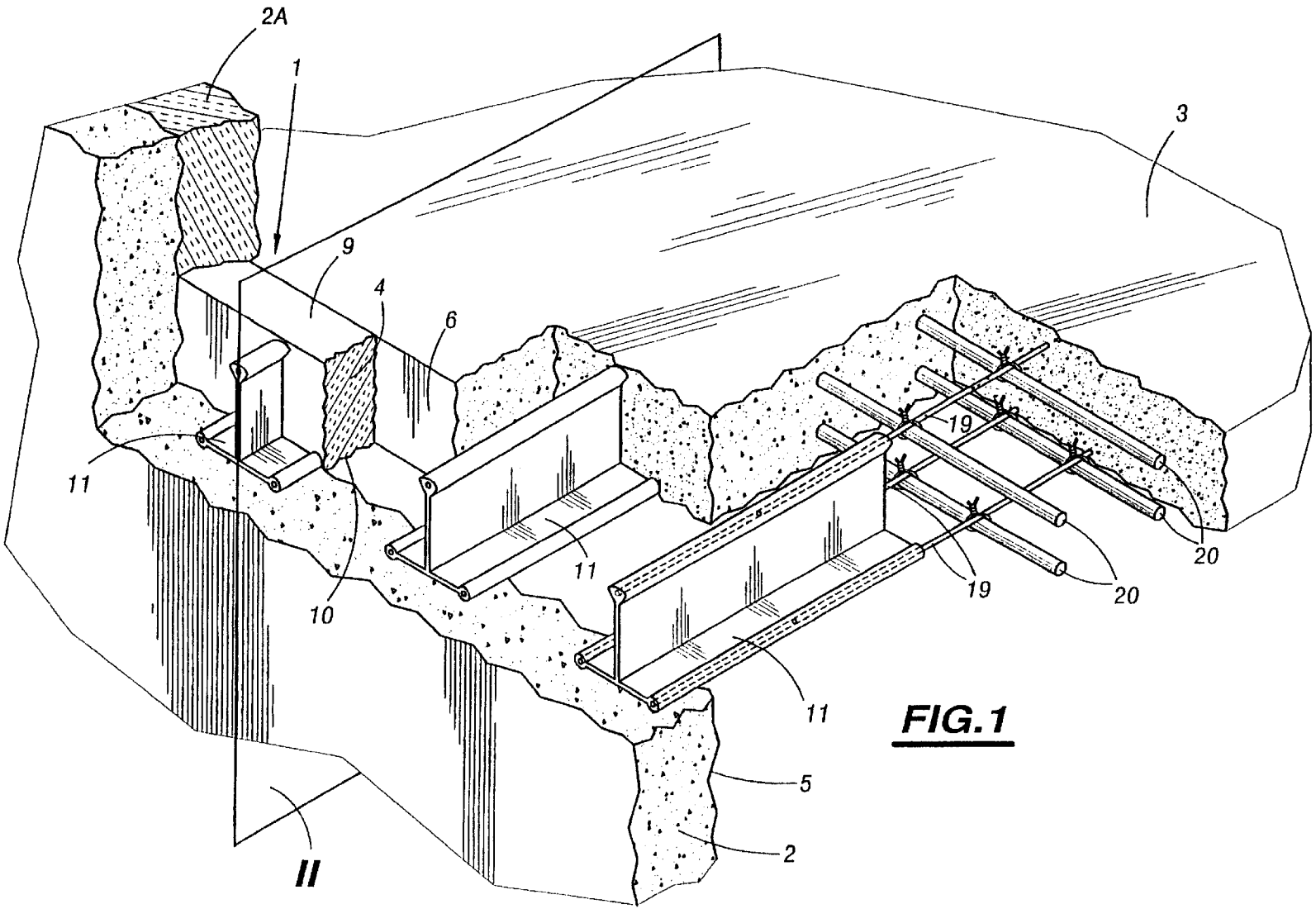
FIG. 1 is a partially cut-away perspective view of a portion of a thermal bridge break according to the invention between a concrete slab and a concrete wall.

A thermal bridge break 1 located at the junction of a concrete wall 2 with a concrete slab 3 extending approximately horizontally is illustrated in FIG. 1. It includes a thickness of insulation 4 interposed at the junction of the wall 2 with the slab 3 between a face 5 of the wall 2 and one end 6 of the slab 3. The thickness of insulation 4 extends along the length of the junction of the wall 2 with the slab 3 and fills that portion of the space bounded by the end 6 of the slab 3 and the face 5 of the wall 2, these lying at an approximately constant distance from each other.

As an advantageous example, the face 5 of the wall 2, lying on the same side as the slab 3, is coated with an insulation 2A.

The thickness of insulation 4 is limited upwards and downwards by two faces 9 and 10 respectively, which lie along the extension of the upper and lower faces of the slab 3, respectively.

The material making up the thickness of insulation 4 is fireproofed. This may be made of polystyrene, glass wool or rock wool.

The slab 3 extends approximately horizontally above a void, for example above the floor of a lower storey. Beams 11 anchor the slab 3 into the wall 2 and support the slab 3 on the wall side. They are uniformly distributed along the length of the junction of the wall 2 with the slab 3. They lie in a plane approximately parallel to the plane of the slab 3 and are directed approximately perpendicular to the face 5 of the wall 2. The beams 11 extend in an edge of the space bounded by the upper and lower surfaces of the slab 3.

Figure 2:
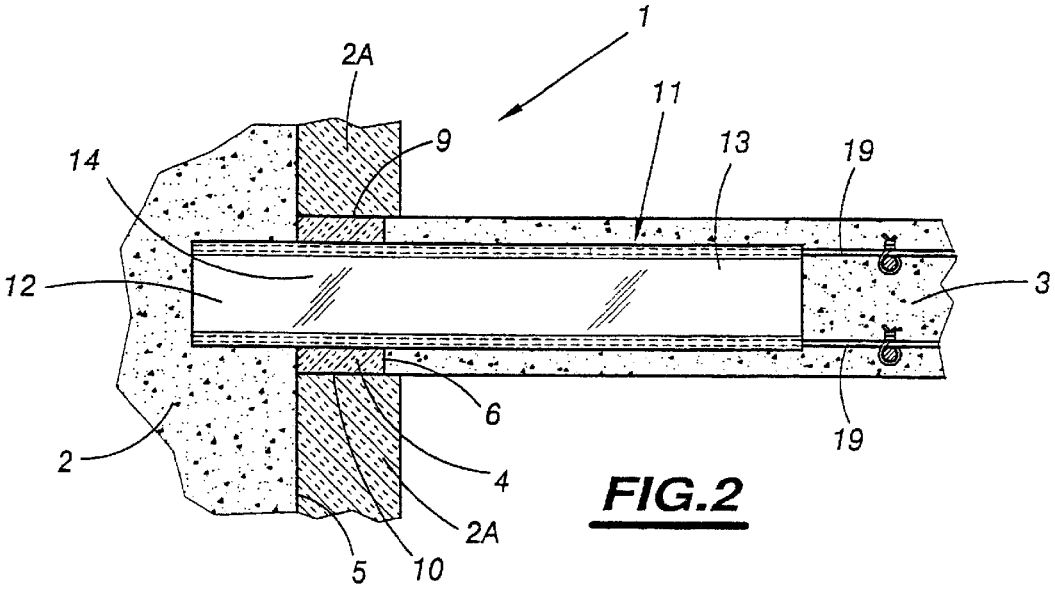
FIG. 2 is a section in the plane II of FIG. 1.

As may be seen in FIG. 2, each beam 11 has, at a first end, a first portion 12 embedded in the concrete of the wall 2. On the opposite side from its first end, the beam 11 has a second portion 13 embedded in the concrete of the slab 3. A third portion 14 of the beam 11, intermediate between the first portion 12 and the second portion 13, passes right through the thickness of insulation 4.

Figure 3:
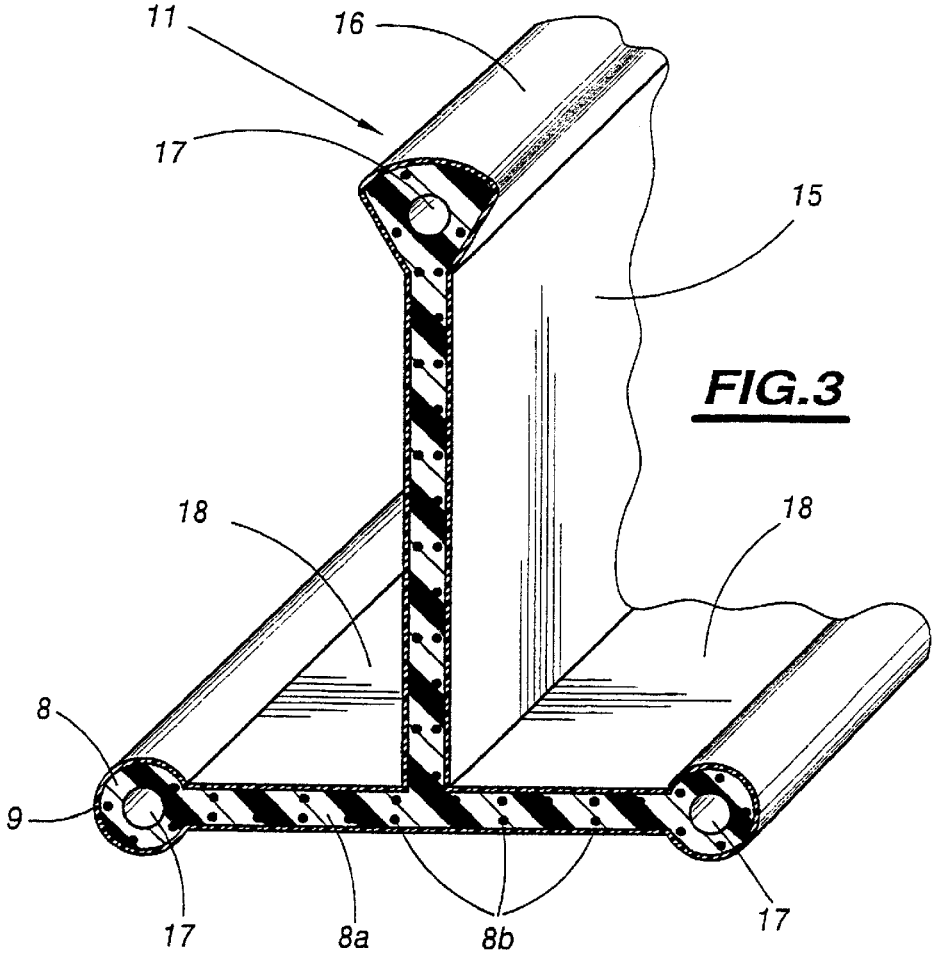
FIG. 3 is a perspective view on a larger scale of a portion of a beam cut transversely, intended to form part of the construction of the thermal bridge break illustrated in FIG. 1.

A portion of the beam 11, cut out transversely, is illustrated in perspective on a larger scale in FIG. 3. This beam 11 is made of a composite 8 of a polymer matrix 8*a* reinforced with a crossed network of glass fibres 8*b* and treated in order to be fire-resistant. The beam 11 has a coating 9 which protects the glass fibres from alkaline attack by the concrete during the maturation phase. The coating 9 consists of a resin which does not hydrolyze in the presence of water.

Figure 5:
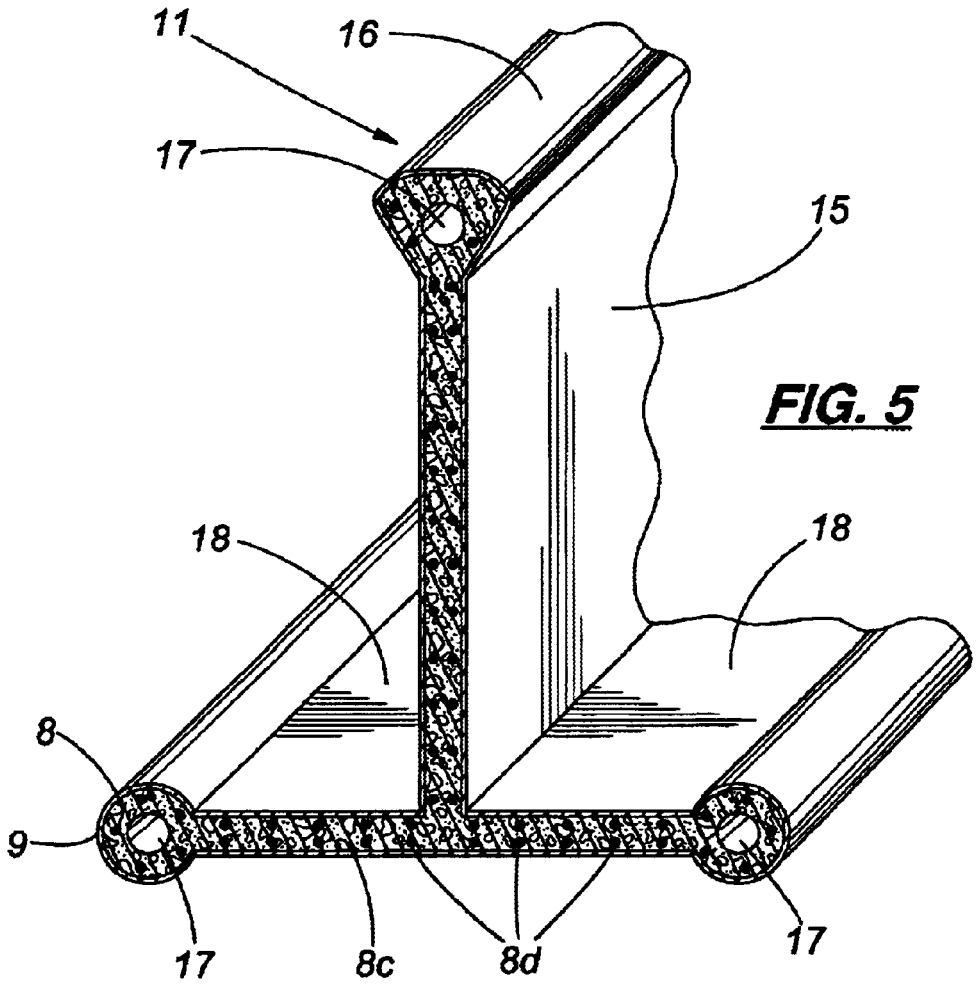
FIG. 5 is a perspective view like FIG. 3 but illustrating a different construction.

In another embodiment as illustrated in FIG. 5, the beam 11 is made of a high-performance concrete 8*c* reinforced with polyethylene fibres 8*d*.

These composites have thermal conductivities of about 0.6 W/(m.K), which are markedly lower than that of steel, which is about 53 W/(m.K). It should be recalled here that the thermal conductivity of insulation such as glass wool or rock wool is around 0.04 W/(m.K). The use of these composites for producing a thermal bridge break is therefore particularly advantageous.

The beam 11 has the overall shape of a section or a profile. If the constituent material of the beam is a polymer reinforced with a network of glass fibres, the section may advantageously be pultruded.

The heat flux between the slab 3 and the wall 2 propagates in a direction approximately parallel to the overall direction of the beam 11. Consequently, the smaller the cross-section of the beam 11, the smaller the flow area for the heat flux and the lower the amount of heat flowing between the wall 2 and the slab 3 through the beam 11. The thermal performance of the beam 11 is therefore essentially determined by the area of its cross-section and not its shape. In contrast, its mechanical resistance to the various stresses to which it is subjected once in place is very dependent on the shape of its cross-section.

A beam 11 whose cross-section has the overall shape of an I or a T with a bulge located at the free end of its base has turned out to benefit from this particular feature. This is because the cross-section of such a beam 11 is optimized so as to have a minimum surface area while providing the said beam 11 with optimal mechanical properties in terms of resistance to the particular stresses to which it is designed to be subjected.

Once the beam is in place, the sagittal plane of the I or that of the T is oriented approximately vertically. With the I-beam, pouring of the concrete is made more difficult and the occurrence of defects associated with this operation is made more likely. The T-section, insofar as it favours the flow of the concrete around the beam 11, is preferred.

The beam 11 illustrated in FIGS. 3 and 5 has such a cross-section in the form of a T. In this view, the T is upside-down, as is the case when the beam 11 is in its definitive position.

At its free end, the base 15 of the T has a bulge 16.

The section includes holes 17, three in number, which extend along its length, two of which are located at the respective ends of the flanges 18 of this T, the final hole lying within the bulge 16 at the free end of the base of the T.

In its definitive position inside the thermal bridge break 1, the beam 11 is oriented so that its sagittal plane or the direction of the base 15 of the T is approximately vertical, as may be seen in FIG. 1. The flanges 18 of the T lie for their part in an approximately horizontal plane. The free end of the base 15 of the T is directed upwards, while its flanges 18 are below.

The beam 11 transmits the weight of the slab 3 to the wall 2. The flanges 18 of the T define a surface embedded in the concrete approximately perpendicular to the direction of the weight of the slab, which forms a bearing surface for the beam 11 on the concrete of the wall 2 allowing the stress associated with the weight of this slab 3 to be distributed. The wall 2 is therefore essentially subjected to a compressive force.

Since the weight of the slab 3 is applied at a certain distance from the embedment of the beam 11 in the wall 2, a moment associated with the weight of the slab 3 is exerted in the region of this embedment. Here again, the upper and lower surfaces bounded by the flanges 18 of the T favour the distribution in the embedment region of the stresses associated with this moment.

As regards the intermediate portion 14 of the beam 11, this is subjected, on the one hand, to a shear force relating to the transmission of the weight of the slab 3 and, on the other hand, to a bending moment resulting from the remoteness of the point of application of this weight of the slab 3. The surface area of the cross-section of the beam 11 allows it to support the shear force. As regards the bending moment, this is the moment of inertia of the beam 11 which is involved and which is desired to be a maximum. The shape of the beam 11 is from this point of view entirely beneficial because of the presence of material at each end of the base 15 of the T, namely, on the one hand, the flanges 18 of the T and, on the other hand, the bulge 16 located at the free end of the base 15 of the T.

In the region where the beam 11 is embedded inside the slab 3, there are again substantially the same mechanical phenomena as those described previously involved in the region where the beam 11 is embedded in the wall 2. The portion 13 of the beam 11 embedded in the concrete of the slab 3 supports the weight of this slab 3. Again, the surface defined by the flanges 18 of the T takes up most of the weight of the slab 3, and does so in a distributed manner. However, in this case it is essentially that one of the surfaces bounded by the flanges 18 which faces upwards which is stressed.

The slab 3 may also be subjected to stresses which tend to move it away from the wall and cause the beam 11 to be pulled out. Advantageously, additional means for fastening the beam to the slab are provided, for example in the form of cramps or means of joining to a rebar reinforcing the concrete of the slab 3 in which it is embedded.

In FIGS. 1 and 2, the said joining means consist of iron bars which are housed in the holes 17 and extend from the beam 11, into the slab 3, to a rebar 20 embedded in the latter and to which they are joined.

When the beam 11 is not intended to house such iron bars 19, it may not contain such holes 17.

Figure 4:
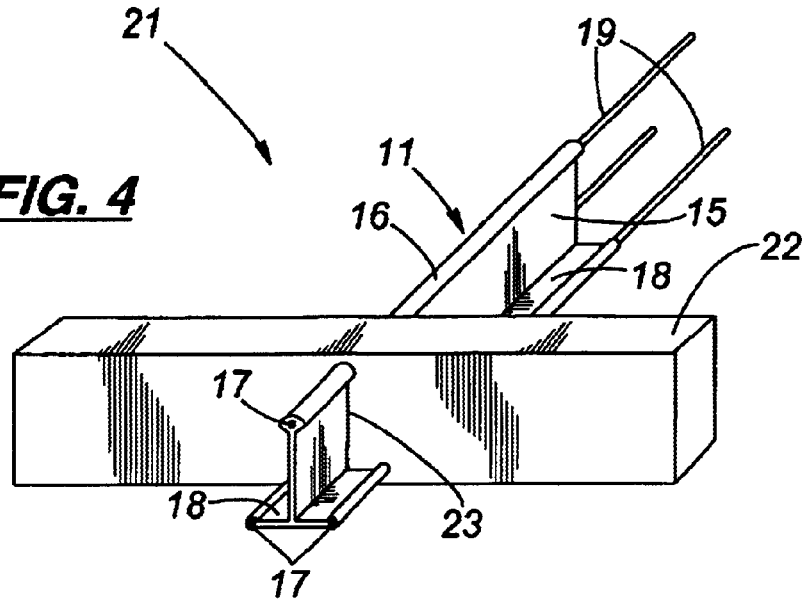
FIG. 4 is a perspective view of an elementary module intended to form part of the construction of the thermal bridge break illustrated in FIG. 1.

An elementary module 21 illustrated in FIG. 4 is intended to form Dart of the construction of a thermal bridge break 1 as described above. It comprises an element 22 made of insulating material intended to make up the thickness of insulation 4.

The element 22 made of insulating material has the overall shape of a parallelepiped which extends preferably along a direction perpendicular to that of the beam 11 which passes right through the element 22.

The element 22 has a channel 23 which houses the beam 11, the shape of the channel 23 being complementary to that of the said beam 11. The element 22 is, for example, made of glass wool or rock wool. It may also be formed from polystyrene protected by fireproofed panels.

If the face 5 of the wall 2 includes curves, an insulating material exhibiting a degree of flexibility, or even a degree of pliancy, will be preferred because of its ability to match the shapes of the face 5.

The elementary module 21 advantageously includes iron bars 19, in this case three in number, housed in the holes 17 which extend along the length of the beam 11. They extend by a certain length from the end of the beam 11 which is intended to be embedded in the concrete of the slab 3. Advantageously, the length of penetration of the iron bars 19 into the holes 17 of the beam 11 is just sufficient to allow good mutual fastening of the iron bars 19 and the beam 11, since these iron bars favour, moreover, the propagation of heat towards or from the wall 2.

The elementary module 21 is either in the form of a unit ready to be assembled or, as may be seen in FIG. 4, in an already assembled form.

Such elementary modules 21 are intended to be juxtaposed along the length of the junction between the wall 2 and the slab 3 in order to form a thermal bridge break 1 as described above.

Such an elementary ready-to-use module may be quickly fitted on a site. Now, in general, it is desirable to reduce as much as possible the durations of the operations carried out directly on the site. This is because the longer these operations are, the more expensive they are in terms of labour, and the more they tend to lengthen the time on site and to complicate the organisation thereof.

The polymer reinforced with a network of glass fibres provides a very satisfactory compromise between its low thermal conductivity on the one hand and its mechanical behaviour on the other, while holding its costs to a low level.

Although the arrangement that has just been described is regarded as being applied to a concrete wall, it may also be applied to any type of wall, for example a wall made from stone, blocks, bricks or other material.

Of course, the invention is not limited to the slabs which separate two consecutive storeys of a building. It may, for example, be used in the manufacture of balconies or loggias.

What is claimed is:

1. Elementary module (21) intended to form a thermal bridge break (1) between a wall (2) and a concrete slab (3) extending approximately horizontally above a void, wherein said module comprises:

at least one beam designed to anchor and to support the horizontal concrete slab into the wall, this beam being made of a composite material reinforced with fibres and being capable of resisting, on the one hand, a shear force relating to the transmission of the weight of the slab, and on the other hand, a bending moment resulting from the remoteness of the point of application of the weight of the slab, the composite material having a thermal conductivity lower than that of steel, and a longitudinal element (22), made of an insulating material, which is intended to be interposed between the slab (3) and the wall (2), and right through which at least one channel (23) for housing the beam (11) passes.

2. Elementary module (21) according to claim 1, characterized in that the beam (11) is made in the form of a section made of a polymer reinforced with a network of glass fibres and treated in order to be fireproof.

3. Elementary module (21) according to claim 1, characterized in that one portion (13) of the beam (11), located at one end of the beam (11) and intended to be embedded in the slab (3), includes additional means (19) for fastening to the slab (3), said additional means being designed to resist stresses which tend to move the slab (3) away from the wall.

4. Elementary module (21) according to claim 3, characterized in that the additional fastening means (19) comprise cramps.

5. Elementary module (21) according to claim 3, characterized in that the additional fastening means (19) comprise means (19) for joining to a rebar (20) in the slab (3).

6. Elementary module (21) according to claim 5, characterized in that the section of the beam (11) defines holes (17) which extend along its length and are each intended to firmly house an iron bar (19) forming a means of joining to the rebars (20) of the slab (3).

7. Elementary module (21) according to claim 6, characterized in that the beam (11) is made in the form of a section.

8. Elementary module (21) according to claim 1, characterized in that the beam (11) includes a coating (9) capable of withstanding hydrolysis.

9. Elementary module (21) according to claim 8, characterized in that the coating (9) is made of a resin.

10. Elementary module (21) according to claim 1, characterized in that the beam (11) is made of a concrete reinforced with polyethylene fibres.

11. Elementary module (21) according to claim 1, characterized in that the beam (11) has the overall shape of a section with a cross-section substantially in the form of a T.

12. Elementary module (11) according to claim 11, characterized in that the cross-section of the beam (11) has a bulge (16) lying substantially at the free end of the base (15) of the T.

13. Elementary module according to claim 1, wherein the composite material is a non-multilayer composite material.

14. Elementary module according to claim 1, wherein the composite material has a thermal conductivity of about 0.6 W/m.k.

15. Building structure comprising:

at least one wall (2);

at least one approximately horizontal concrete slab (3), and at least one thermal bridge break (1) having a longitudinal element made of insulating matter interposed at the junction of the wall (2) with the slab (3) between a face (5) of the wall (2) and a corresponding end (6) of the slab (3), wherein the thermal bridge break (1) comprises a plurality of elementary modules (21), according to claim 1, distributed uniformly along the junction, each of the beams (11) of said elementary modules (21) having, at a first end, a first portion (12) rigidly secured to the wall (2), at a second end, a second portion (13) embedded in the concrete of the slab (3) and a third portion (14) intermediate between the first portion (12) and the second portion (13) and passing through a respective said longitudinal element (22), the plurality of beams (11) supporting the slab (3) on the wall (2) side and anchoring the slab into the wall (2).

16. Building structure according to claim 15, comprising an elementary module (21) in which each beam (11) has an overall shape of a section with a cross-section substantially in the form of a T, characterized in that the base (15) and the flanges (18) of the T which substantially define the cross-section of the beam (11) are oriented in approximately vertical and approximately horizontal directions, respectively.

17. Building structure according to claim 16, characterized in that the base (15) of the T which substantially defines the cross-section of the beam (11) faces approximately upwards and in that the flanges (18) of the T are below this base (15).

18. Building structure comprising:

at least one wall (2);

at least one approximately horizontal concrete slab (3); and at least one thermal bridge break (1) having a longitudinal element, made of insulating matter, interposed at the junction of the wall (2) with the slab (3) between a face (5) of the wall (2) and a corresponding end (6) of the slab (3), wherein the thermal bridge break (1) comprises a plurality of elementary modules 21), according to claim 2, distributed uniformly along the junction, each of the beams (11) of the said elementary modules (21) having, at a first end, a first portion (12) rigidly secured to the wall (2), at a second end, a second portion (13) embedded in the concrete of the slab (3) and a third portion (14) intermediate between the first portion (12) and the second portion (13) and passing through a respective said longitudinal element (22).

the plurality of beams (11) supporting the slab (3) on the wall (2) side and anchoring the slab into the wall (2).

19. Building structure comprising:

at least one wall (2);

at least one approximately horizontal concrete slab (3); and at least one thermal bridge break (1) having a longitudinal element, made of insulating matter, interposed at the junction of the wall (2) with the slab (3) between a face (5) of the wall (2) and a corresponding end (6) of the slab, wherein the thermal bridge break (1) comprises a plurality of elementary modules (21), according to claim 10, distributed uniformly along the junction, each of the beams (11) of said elementary modules (21) having, at a first end, a first portion (12) rigidly secured to the wall (2), at a second end, a second portion (13) embedded in the concrete of the slab (3) and a third portion (14) intermediate between the first portion (12) and the second portion (13) and passing through respective said longitudinal element (22), the plurality of beams (11) supporting the slab (3) on the wall (2) side and anchoring the slab into the wall (2).

20. Building structure comprising:

at least one wall (2);

at least one approximately horizontal concrete slab (3) ; and at least one thermal bridge break (1) having a longitudinal element, made of insulating matter (4), interposed at the junction of the wall (2) with the slab (3) between a face (5) of the wall (2) and a corresponding end (6) of the slab (3), wherein the thermal bridge break (1) comprises a plurality of elementary modules (21), according to claim 11, distributed uniformly along the junction, each of the beams (11) of said elementary modules (21) having, at a first end, a first portion (12) rigidly secured to the wall (2), at a second end, a second portion (13) embedded in the concrete of the slab (3) and a third portion (14) intermediate between the first portion (12) and the second portion (13) and passing through a respective said longitudinal element (22), the plurality of beams (11) supporting the slab (3) on the wall (2) side and anchoring the slab into the wall (2), and wherein the base (15) and the flanges (18) of the T, which substantially define the cross-section of the beam (11); are oriented in approximately vertical and approximately horizontal directions, respectively.

21. Elementary module (21) intended to form a thermal bridge break (1) between a wall (2) and concrete slab (3), and extending approximately horizontally above a void, wherein said module:

at least one beam designed to anchor and to support the horizontal concrete slab into the wall, said beam being made of a composite material reinforced with fibres and being capable of resisting, on the one hand, a shear force relating to the transmission of the weight of the slab, and on the other hand, a bending moment resulting from the remoteness of the point of application of the weight of the slab, the composite material having a thermal conductivity lower than that of steel; and a longitudinal element (22), made of an insulating material, which is intended to be interposed between the slab (3) and the wall (2), and right through which at least one channel (23) for housing the beam (11) passes;

wherein the beam (11) is made in the form of a section made of a polymer reinforced with a network of glass fibres and treated in order to be fireproof.

22. Elementary module (21) intended to form a thermal bridge beak (1) between a wall (2) and concrete slab (3), and extending approximately horizontally above a void, wherein said module it comprises:

at least one beam designed to anchor and to support the horizontal concrete slab into the wall, said beam being made of a composite material reinforced with fibres and being capable of resisting, on the one hand, a shear force relating to the transmission of the weight of the slab, and on the other hand, a bending moment resulting from the remoteness of the point of application of the weight of the slab, the composite material having a thermal conductivity lower than that of steel, and a longitudinal element (22) made of an insulating material, which is intended to be interposed between the slab (3) and the wall (2) and right through which at least one channel (23) for housing the beam (11) passes;

in that the beam (11) is made of a high performance concrete reinforced with polyethylene fibres.

23. Elementary module (21) intended to form a thermal bridge break (1) between a wall (2) and concrete slab (3), extending approximately horizontally above a void wherein said module comprises:

at least one beam designed to anchor and to support the horizontal concrete slab into the wall, said beam being made of a composite material reinforced with fibres and being capable of resisting, on the one hand, a shear force relating to the transmission of a weight of the slab, and on the other hand, a bending moment resulting from the remoteness of the point of application of the weight of the slab, the composite material having a thermal conductivity lower than that of steel, and a longitudinal element (22), made of an insulating material, which is intended to be interposed between the slab (3) and the wall (2), and right through which at least one channel (23) for housing the beam (11) passes, and in that the beam (11) has the overall shape of a section with a cross-section substantially in the form of a T.

* * * * *